US005175489A

United States Patent [19]

Mizuide

[11] Patent Number: 5,175,489

[45] Date of Patent: Dec. 29, 1992

[54] CURRENT-DETECTING CIRCUIT

[75] Inventor: Yasuo Mizuide, Kawasaki, Japan

[73] Assignee: Kabushiki Kaisha Toshiba, Kanagawa, Japan

[21] Appl. No.: 689,744

[22] PCT Filed: Sep. 28, 1990

[86] PCT No.: PCT/JP90/01253

§ 371 Date: May 21, 1991

§ 102(e) Date: May 21, 1991

[30] Foreign Application Priority Data

Oct. 2, 1989 [JP] Japan ..... 1-255274

[51] Int. Cl.[5] ..... G05F 3/16

[52] U.S. Cl. ..... 323/315; 323/312

[58] Field of Search ..... 323/312, 313, 314, 315, 323/316, 277, 278

[56] References Cited

U.S. PATENT DOCUMENTS 4,308,496 12/1981 Nagano ..... 323/315
5,027,004 6/1991 Palara ..... 323/315

FOREIGN PATENT DOCUMENTS 51-108748 9/1976 Japan .
52-53252 4/1977 Japan ..... 323/315
56-6508 1/1981 Japan .
56-78205 6/1981 Japan .

OTHER PUBLICATIONS

"Toshiba Integrated Circuit Technical Data TA7272P" (2 pages), Toshiba Corporation (Sep. 26, 1989).

*Primary Examiner*—Steven L. Stephan
*Assistant Examiner*—Adolf Berhane
*Attorney, Agent, or Firm*—Finnegan, Henderson, Farabow, Garrett and Dunner

[57] ABSTRACT

A current-detecting circuit detects the value of a current which flows out of an output circuit incorporated in an integrated circuit. A current-detecting resistor (17) is located at an intermediate point of the path along which the current flows out of the output circuit. The emitters of two NPN transistors (15, 16), for which a collector area ratio of N:1 is determined, are connected to the ends of the resistor (17), respectively. The bases of the NPN transistors (15, 16) are connected together, and the base and collector of one (15) of the NPN transistors are connected together. A current mirror circuit (14), which is made up of two PNP transistors (12, 13) and for which an input-to-output current ratio of M:1 determined, is connected to the collectors of the NPN transistors (15, 16). The base of an output NPN transistor (18) is connected to a node to which the collector of one (13) of the PNP transistors and the collector of one (16) of the NPN transistors are connected in common.

6 Claims, 2 Drawing Sheets

CURRENT-DETECTING CIRCUIT

FIELD OF THE INVENTION

The present invention relates to a current-detecting circuit, incorporated in a bipolar type integrated circuit, for preventing an excessive current from flowing when a signal produced in the integrated circuit is output.

DISCUSSION OF THE RELATED ART

In an output circuit incorporated in a bipolar type integrated circuit, the output transistor may break down if an excessive current flows from an output terminal. In order to prevent the breakdown of the output transistor, the current flowing from the output terminal is monitored by a current-detecting circuit, and the operation of the output circuit is stopped if the value measured by the current-detecting circuit exceeds a predetermined value.

FIG. 1 is a schematic diagram of a conventional current-detecting circuit. As is shown in FIG. 1, a current-detecting resistor 41 is inserted in the path along which current i flows. If the voltage drop across the resistor 41 exceeds the base-emitter voltage $V_{BE}$ of an NPN transistor 42, this transistor 42 is turned on, and a signal indicating the flow of a predetermined amount of current appears at the collector of the transistor 42.

In the conventional current-detecting circuit mentioned above, a detection output is produced in accordance with the relationship between the voltage drop across the current-detecting resistor 41 and the base-emitter voltage $V_{BE}$ of the transistor 42. Since the base-emitter voltage $V_{BE}$ of the transistor 42 is about 0.7 V, the resistance of the resistor 41 should be as low as 0.7 Ω or so, so as to detect a current of 1 A.

In the meantime, the voltage and power which are lost in the current-detecting resistor 41 are inevitably large. In the case where a current of e.g. 1 A is detected, the voltage loss in the resistor 41 is as high as 0.7 V, while the power loss therein is as high as 0.7 W. This being so, it is desirable that the resistor 41 incorporated in the integrated circuit be a diffused resistor. However, since it is not easy to provide a diffused resistor with low resistance of 0.7 Ω or so, the resistor 41 has to be a discrete resistor externally connected to the integrated circuit. Due to the need to employ such a discrete resistor, structure is large, and the manufacturing cost is high, accordingly.

In the conventional current-detecting circuit, the value of a detection current is determined by the base-emitter voltage $V_{BE}$ of the transistor 42 and the resistance of the current-detecting resistor 41. Due to the temperature-dependent characteristic of voltage $V_{BE}$, therefore, the value of the detection current is unstable. Let it be assumed that the temperature increases 100° C. Since, in this case, the base-emitter voltage $V_{BE}$ decreases from 0.7 V to 0.5 V or so, the detection voltage decreases 28%, resulting in a decrease in the detection current.

The present invention has been developed in consideration of the above circumstances, and is intended to provide a current-detecting circuit which can be incorporated in an integrated circuit, has little voltage loss and little power loss, and produces a detection current that is not much dependent on the temperature.

SUMMARY OF THE INVENTION

A current-detecting circuit according to the present invention comprises: a current mirror circuit which is made up of first and second transistors that are of the first polarity and have their emitters connected to each other, and for which an input-to-output current ratio of M:1 (M: a real number equal to or larger than 1) is determined; a third transistor which is of the second polarity and has its collector and base connected to the collector of the first transistor of the current mirror circuit; a fourth transistor which is of the second polarity, has its collector connected to the collector of the second transistor of the current mirror circuit, and has its base connected to the base of the third transistor, and which has an emitter area N times (N: a real number equal to or larger than 1) wider than that of the third transistor; a current-detecting resistor element which is connected between the emitters of the third and fourth transistors; and fifth transistor which is of the first polarity and has its base connected to a node to which the collectors of the second and fourth transistors are connected in common.

With this circuit arrangement, the current mirror circuit distributes a given current to the third and fourth transistors at the predetermined ratio. Since a current flows through the current-detecting resistor element connected between the emitters of the third and fourth transistors, the potential at the emitter of the fourth transistor rises. When a current corresponding to the input-to-output current ratio of the current mirror circuit begins to flow through the third and fourth transistors, the fifth transistor is turned on, thus producing a detecting output.

DETAILED DESCRIPTION OF THE PREFERRED EMBODIMENTS

Embodiments of the present invention will now be described, with reference to the accompanying drawings.

Figure 1:
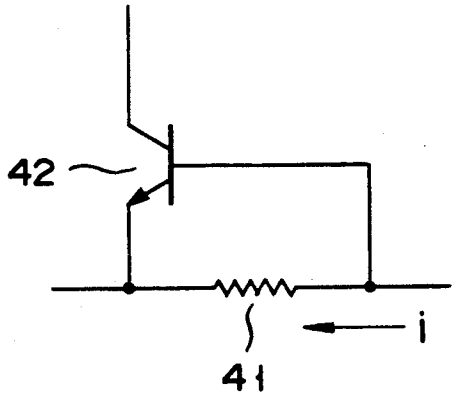
FIG. 1 is a schematic circuit diagram showing the structure of a conventional current-detecting circuit.
Figure 2:
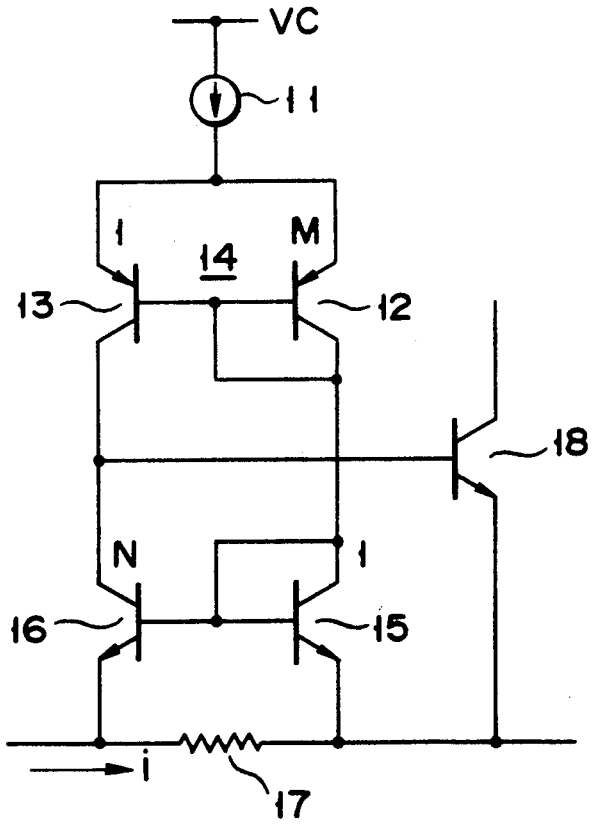
FIG. 2 is a circuit diagram showing the structure of the first embodiment of the present invention.

FIG. 2 is a circuit diagram showing the structure of the first embodiment of the present invention. One end of a current source 11 is connected to a point to which a power supply voltage VC is applied, while the other end of the current source 11 is connected to each of the emitters of two PNP transistors 12 and 13. The bases of transistors 12 and 13 are connected together, and the base and collector of transistor 12 are connected together. With this arrangement, transistors 12 and 13 jointly constitute a current mirror circuit 14. In this current mirror circuit 14, the emitter area of transistor 12 is M times wider than that of transistor 13 (M: a real number equal to or larger than 1). The input-to-output current ratio of the current mirror circuit 14 is determined as M:1.

The collector and base of NPN transistor 15 are connected to the collector of transistor 12. The collector of an NPN transistor 16 is connected to the collector of transistor 13. The base of transistor 16 is connected to the base of transistor 15. The emitter area of transistor 16 is N times wider than that of transistor 15 (N: a real number equal to or larger than 1). A current-detecting resistor 17 is inserted between the emitters of transistors 15 and 16. The base of NPN transistor 18, which outputs a detection signal, is connected to a node to which the collectors of transistors 13 and 16 are connected in common. The emitter of transistor 18 is connected to the emitter of transistor 15, and the collector thereof is connected through a load circuit (not shown) to an appropriate point, such as a point to which the power supply voltage VC is applied. With respect to the circuit of the embodiment, there can be a case where either M or N is set to be "1".

Next, the operation of the circuit having the above structure will be described.

The input-to-output current ratio of the current mirror circuit 14 is set to be M:1, so that when a current having a value of "1" flows through one transistor 13, a current having a value of "M" flows through the other transistor 12. Moreover, the bases of transistors 15 and 16 are connected together, and the base and collector of transistor 15 are connected together. Therefore, transistors 15 and 16 jointly function as a current mirror circuit, provided that the emitter potentials of transistors 15 and 16 are at the same level. Let it be assumed that the emitter potentials of transistors 15 and 16 are at the same level. When, in this case, a current having a value of "1" flows through transistor 15, the emitter current of transistor 16 can have a value which is N times larger. In addition, the current following through transistor 13 can have a value M·N times larger. Thus, all the collector current of transistor 13 flows through transistor 16, in the case where no current flows through resistor 17 and where the emitter potentials of transistors 15 and 16 are at the same level. Accordingly, transistor 18 is turned off, and a detection signal, i.e., the collector signal of transistor 18, is set at the "1" level.

Let it be assumed that current i flows through the resistor 17 in the direction indicated. As a result of the flow of this current i, the potential at the emitter of transistor 16 is raised with reference to that of transistor 15. The collector current of transistor 16 decreases, due to the rise of the emitter potential thereof. Therefore, the value of current i increases. When the value of the collector current flowing through transistor 16 has become smaller than the value of the collector current of transistor 13, a base current begins to flow through transistor 18, thus switching this transistor 18 from OFF to ON. Since the detection signal, i.e., the collector signal of transistor 18, is reversed and set at the "0" level at the time, a predetermined amount of current flowing through the current-detecting resistor 17 can be sensed.

In the circuit of the above embodiment, the detection voltage Vdet appearing at the current-detecting resistor 17, i.e., the voltage drop which occurs across that resistor 17 when transistor 18 is switched from OFF to ON, is given by the following formula:

$$Vdet = K \cdot T/q \times lnM \cdot N \quad (1)$$

where K is a Kelvin constant, T is an absolute temperature, and q is an electron charge.

The detection voltage Vdet given by formula (1) corresponds to the difference $\Delta V_{BE}$ between the base-emitter voltage $V_{BE}$ appearing when the emitter current having a value of "1" flows through transistor 16 and that appearing when the emitter current having a value of "M·N" flows through the same transistor 16.

Therefore, the current detection level idet can be given by the formula below, provided that the resistance of the resistor 17 is r.

$$idet = 1/r \times K \cdot T/q \times lnM \cdot N \quad (2)$$

If the value of M·N is set to be "4", for example, then the detection voltage Vdet given by formula (1) is 36 mV. In order to detect a current of 1 A, with the value of M·N set as above, the resistance of the resistor 17 should be 36 mΩ, and the power loss in the resistor 17 having this resistance is 36 mW. A resistor having such small voltage loss and power loss can be formed by an aluminum pattern and can be easily incorporated in an integrated circuit. For example, the resistor 17 adapted for the detection of a current of 1 A can be obtained by preparing an aluminum pattern of 20 mΩ□ and determining the width W and length L of this pattern such that the L/W ratio is 1.8. The power loss in this resistor 17 is very small; it is as small as 36 mW.

In the case where the resistor is formed by an aluminum pattern, the temperature coefficient of the electric resistance is about +3,000 ppm. Since such a temperature coefficient and the detection voltage (which changes in proportion to the absolute temperature) cancel each other, stable temperature characteristics are ensured.

Figure 3:
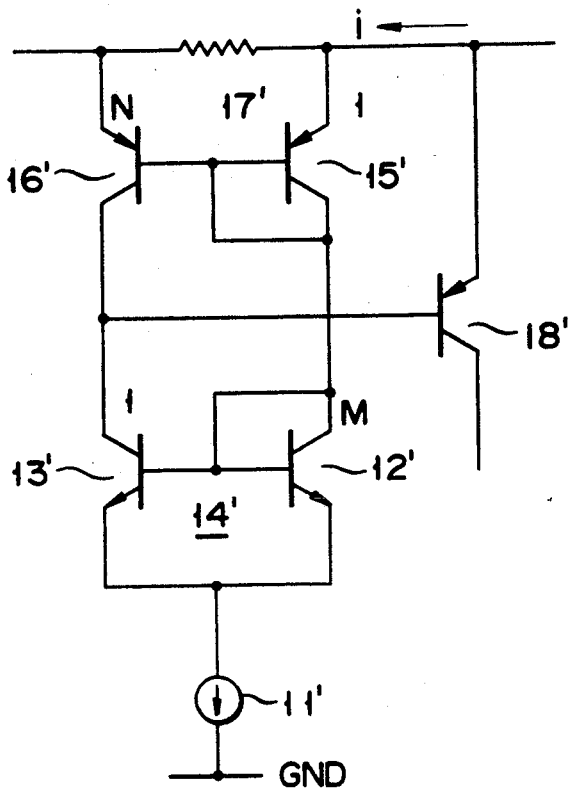
FIG. 3 is a circuit diagram showing the structure of the second embodiment of the present invention.

FIG. 3 is a circuit diagram showing the structure of the second embodiment of the present invention. The circuit of the second embodiment differs from the circuit of the first embodiment shown in FIG. 2, in that the transistors of the former have opposite polarities from the corresponding transistors of the latter. Therefore, those structural elements which have corresponding ones in the circuit shown in FIG. 2 are denoted by reference numerals followed by a prime (′), and a description to the second embodiment will be omitted herein. With respect to the second embodiment, it should be noted that one end of a current source 11′ is connected to a point to which a ground voltage GND is applied.

Figure 4:
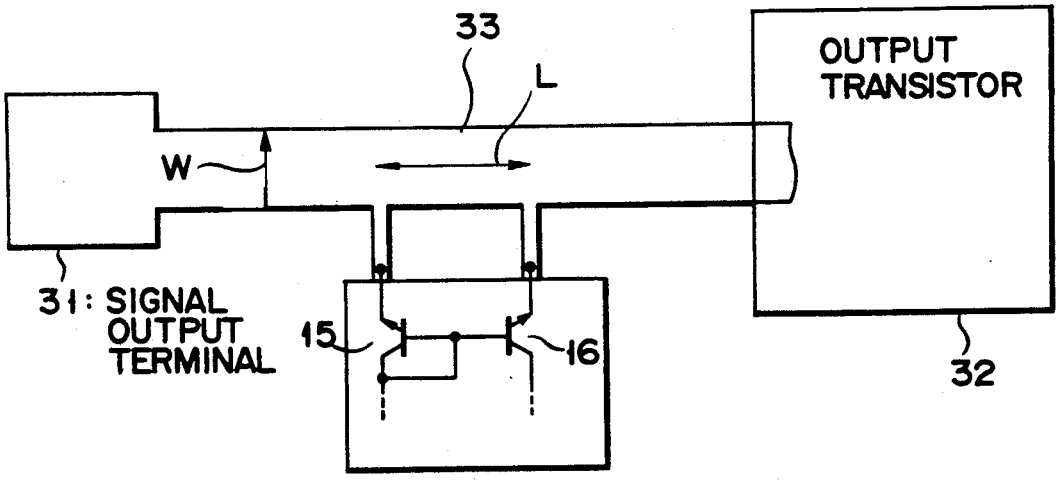
FIG. 4 is a horizontal pattern view showing the specific structure of a resistor employed in each of the embodiments.

FIG. 4 is a horizontal pattern view showing the specific structure of the resistor 17 (17′) employed in each of the embodiments. In FIG. 4, reference numeral 31 denotes a signal output terminal (i.e., an output pad) of an integrated circuit, and reference numeral 32 denotes an output transistor arranged in an output circuit which generates a signal to be output from the terminal 31. The terminal 31 and the output transistor 32 are connected together by means of a wiring layer 33 formed by an aluminum pattern. The current-detecting resistor 17 (17′) is formed by utilizing part of the wiring layer 33. In the case where the wiring layer 33 is formed by an aluminum pattern of 20 mΩ□ and the resistance of the resistor 17 is set to be 36 mΩ, a pattern portion having a length L (see FIG. 4) which is 1.8 times greater than the width W (see FIG. 4) of the aluminum pattern is determined. Two wiring layers, which are sufficiently narrower and shorter than the aluminum pattern, are lead from the two ends of that pattern portion, respectively, and are connected to the emitters of transistors 15 and 16 (15′ and 16′), respectively. In this manner, the resistor 17 (17′) is fabricated.

As has been described, the current-detecting circuit of the present invention has little voltage loss and little power loss and produces a detection current that is not much dependent on the temperature. The current-detecting circuit is particularly advantageous when it is incorporated in a bipolar type integrated circuit.

What is claimed is:

1. A current-detecting circuit comprising:

a current mirror circuit including first and second transistors of a first polarity, an emitter of said first transistor being connected to an emitter of said second transistor, said first transistor having a vase and collector connected to each other, said current mirror circuit having an input-to-output current ratio of M:1 wherein M is a real number greater than or equal to 1;

a power current source connected to a node to which said emitters of said first and second transistors are commonly connected;

a third transistor of a second polarity, said third transistor having a collector and a base directly connected to said collector of said first transistor;

a fourth transistor of said second polarity, said fourth transistor having a collector connected to a collector of said second transistor, and a base connected to said base of said third transistor, said fourth transistor having an emitter area N times wider than an area of an emitter of said third transistor wherein N is a real number greater than or equal to 1;

a current-detecting resistor element connected between said emitters of said third and fourth transistors; and a fifth transistor of said second polarity, said fifth transistor having a base connected to a node to which said collectors of said second and fourth transistors are commonly connected.

2. A current-detecting circuit according to claim 1, wherein said M of said input-to-output current ratio of said current mirror circuit is equal to 1.

3. A current-detecting circuit according to claim 1, wherein said current-detecting resistor element is formed of aluminum.

4. A current-detecting circuit according to claim 1, wherein said first and second transistors are PNP bipolar transistors, and said third, fourth and fifth transistors are NPN bipolar transistors.

5. A current-detecting circuit according to claim 1, wherein said first and second transistors are NPN bipolar transistors, and said third, fourth and fifth transistors are PNP bipolar transistors.

6. A current-detecting circuit according to claim 1 wherein said N of said emitter area ratio of said fourth transistor to said third transistor is equal to 1.

* * * * *

UNITED STATES PATENT AND TRADEMARK OFFICE

CERTIFICATE OF CORRECTION

PATENT NO. : 5,175,489

DATED : December 29, 1992

INVENTOR(S) : Yasuo Mizuide

It is certified that error appears in the above-indentified patent and that said Letters Patent is hereby corrected as shown below:

Claim 1, column 5, line 12, change "vase" to --base--.

Abstract, line 14, before "determined" insert --is--.

Signed and Sealed this

Eleventh Day of January, 1994

*Attest:*

Bruce Lehman

BRUCE LEHMAN

*Attesting Officer*

*Commissioner of Patents and Trademarks*